US008358951B2

(12) United States Patent
Sato

(10) Patent No.: US 8,358,951 B2
(45) Date of Patent: Jan. 22, 2013

(54) IMAGE FORMING APPARATUS, PROCESS CARTRIDGE AND DEVELOPING CARTRIDGE WITH ELECTRODE

(75) Inventor: Shougo Sato, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/845,294

(22) Filed: Jul. 28, 2010

(65) Prior Publication Data

US 2010/0290803 A1 Nov. 18, 2010

Related U.S. Application Data

(62) Division of application No. 11/476,604, filed on Jun. 29, 2006, now Pat. No. 7,787,797.

(30) Foreign Application Priority Data

Jun. 29, 2005 (JP) ..... 2005-190130

(51) Int. Cl.
*G03G 15/00* (2006.01)

(52) U.S. Cl. ..... 399/90; 399/111; 399/270

(58) Field of Classification Search ..... 399/88, 399/90, 111, 270

See application file for complete search history.

(56) References Cited

U.S. PATENT DOCUMENTS

| | | | | |
|---|---|---|---|---|
| 5,521,693 | A | 5/1996 | Kojima et al. | |
| 6,118,952 | A | 9/2000 | Furuya | |
| 6,185,390 | B1 | 2/2001 | Higeta et al. | |
| 6,311,026 | B1 | 10/2001 | Higeta et al. | |
| 6,345,164 | B1 | 2/2002 | Yokomori et al. | |
| 6,381,430 | B1 | 4/2002 | Yokomori et al. | |
| 6,385,413 | B2 | 5/2002 | Sasaki et al. | |
| 6,871,030 | B2 | 3/2005 | Nishimura | |
| 6,928,252 | B2 * | 8/2005 | Takami et al. | 399/111 |
| 7,062,192 | B2 | 6/2006 | Oguma et al. | |
| 7,085,516 | B2 | 8/2006 | Kawai et al. | |
| 7,181,152 | B2 | 2/2007 | Kuma et al. | |
| 7,239,823 | B2 | 7/2007 | Oguma et al. | |
| 7,369,792 | B2 | 5/2008 | Shiraki | |
| 7,386,253 | B2 | 6/2008 | Ishii et al. | |

(Continued)

FOREIGN PATENT DOCUMENTS

| | | |
|---|---|---|
| EP | 0549400 A2 | 6/1993 |
| EP | 0754984 A2 | 1/1997 |

(Continued)

OTHER PUBLICATIONS

Extended European Search Report dated Dec. 19, 2007 in Application No. 06013388.1.

(Continued)

*Primary Examiner* — David Gray
*Assistant Examiner* — Geoffrey Evans
(74) *Attorney, Agent, or Firm* — Banner & Witcoff, Ltd.

(57) ABSTRACT

An image forming apparatus that includes: an image carrier; a developing cartridge detachably mountable with respect to the image carrier; a processing device to which voltage acting between the image carrier and the processing device is applied; and a first electrode, wherein the developing cartridge further includes: a developing roller on which toner is capable of being held; and a second electrode capable of being electrically connected with the first electrode when the developing cartridge is mounted with respect to the image carrier, the processing device further includes: a third electrode capable of being electrically connected with the second electrode when the developing cartridge is mounted with respect to the image carrier, wherein the second electrode positions the developing cartridge in an axial direction of the developing roller.

6 Claims, 4 Drawing Sheets

U.S. PATENT DOCUMENTS

| | | | | |
|---|---|---|---|---|
| 7,412,188 | B2 | 8/2008 | Ishii et al. | |
| 7,450,878 | B2 | 11/2008 | Yano | |
| 7,450,882 | B2 | 11/2008 | Shiraki | |
| 7,522,859 | B2 | 4/2009 | Ishii et al. | |
| 7,561,817 | B2 | 7/2009 | Sato | |
| 7,689,139 | B2 * | 3/2010 | Kamimura | 399/90 |
| 7,693,442 | B2 * | 4/2010 | Sato et al. | 399/90 |
| 7,693,443 | B2 * | 4/2010 | Sato et al. | 399/90 |
| 7,715,746 | B2 * | 5/2010 | Tanabe et al. | 399/90 |
| 7,899,358 | B2 * | 3/2011 | Ishikawa | 399/111 |
| 8,107,853 | B2 * | 1/2012 | Okabe | 399/110 |
| 8,116,652 | B2 * | 2/2012 | Okabe | 399/90 |
| 8,135,300 | B2 * | 3/2012 | Kamimura et al. | 399/90 |
| 8,175,486 | B2 * | 5/2012 | Okabe | 399/90 |
| 2001/0026701 | A1 | 10/2001 | Sasaki et al. | |
| 2003/0156848 | A1 | 8/2003 | Kawai et al. | |
| 2003/0185594 | A1 * | 10/2003 | Okabe | 399/222 |
| 2005/0135832 | A1 * | 6/2005 | Kubota et al. | 399/90 |
| 2005/0201772 | A1 * | 9/2005 | Ishii et al. | 399/90 |
| 2006/0029418 | A1 | 2/2006 | Ishii et al. | |
| 2006/0029419 | A1 | 2/2006 | Shiraki | |
| 2006/0029420 | A1 | 2/2006 | Ishii et al. | |
| 2006/0029421 | A1 | 2/2006 | Ishii et al. | |
| 2006/0029422 | A1 | 2/2006 | Shiraki | |
| 2006/0193652 | A1 | 8/2006 | Sato | |
| 2006/0193653 | A1 | 8/2006 | Oguma et al. | |
| 2006/0291893 | A1 | 12/2006 | Yano | |
| 2009/0169256 | A1 * | 7/2009 | Kamimura et al. | 399/119 |
| 2012/0099890 | A1 * | 4/2012 | Okabe | 399/107 |
| 2012/0107021 | A1 * | 5/2012 | Okabe | 399/262 |

FOREIGN PATENT DOCUMENTS

| | | | |
|---|---|---|---|
| EP | 1117015 | A2 | 7/2001 |
| EP | 1367458 | A1 | 12/2003 |
| EP | 1416331 | A2 | 5/2004 |
| JP | 4-337758 | | 11/1992 |
| JP | 08-160840 | A | 6/1996 |
| JP | 11-184195 | | 7/1999 |
| JP | 11-327288 | | 11/1999 |
| JP | 2004-126030 | | 4/2004 |

OTHER PUBLICATIONS

Office Action for Chinese Patent Application No. 200610100143.5, dated Apr. 4, 2008.

Office Action received for corresponding Japanese Patent Application 2005-190130 mailed Dec. 21, 2010.

Electrophotography-process and simultation, published on Jun. 20, 2008 edited by Hirohaur Hirakura and Hiroyuki Kawamoto; partial translation and excerpt.

* cited by examiner

IMAGE FORMING APPARATUS, PROCESS CARTRIDGE AND DEVELOPING CARTRIDGE WITH ELECTRODE

CROSS REFERENCE TO RELATED APPLICATION

This application is a divisional of U.S. Ser. No. 11/476,604, filed Jun. 29, 2006, which claims priority from Japanese Patent Application No. 2005-190130, filed on Jun. 29, 2005, the entire subject matters of which are incorporated herein by reference.

TECHNICAL FIELD

Aspects of the present invention relate to an image forming apparatus forming an image on a recording medium and, particularly, to an image forming apparatus that forms an electrostatic latent image on the surface of an image carrier, sticks toner on the electrostatic latent image and transfers the toner onto a recording medium to form an image, and to a process cartridge and developing cartridge used in the image forming apparatus.

BACKGROUND

A conventional image forming apparatus includes an image carrier, such as a photosensitive drum, on the surface of which an electrostatic image is formed. The image forming apparatus further includes a developing roller developing the electrostatic latent image by sticking toner on the surface of the image carrier and forms an image by transferring the toner stuck on the surface of the image carrier by the developing roller onto a recording medium. In this type of image forming apparatus, the electrostatic latent image is developed by sticking toner on the surface of the image carrier bearing the electrostatic latent image using the developing roller. The image corresponding to the electrostatic latent image is formed on the recording medium by transferring the stuck toner onto the recording medium.

In this type of image forming apparatus, various processing devices including a charger that uniformly charges the image carrier before the electrostatic latent image is formed on the surface of the image carrier by exposing and a transfer roller that transfers toner stuck on the surface of the image carrier onto the recording medium are provided around the image carrier. Voltage acting between the processing device or the above-mentioned developing roller and the image carrier may be applied (e.g. see JP-A-11-327288).

In the image forming apparatus, the charger and the developing roller are accommodated in a cartridge and detachable from the image carrier. The components are replaceable according to each life span. JP-A-11-184195 discloses an image forming apparatus in which voltage is applied to a developing unit accommodating a developing roller through a charging unit accommodating a charger.

SUMMARY

However, in the conventional image forming apparatus, an electric current may flow into the processing device although the developing cartridge accommodating the developing roller is separated. For example, in the image forming apparatus disclosed in JP-A-11-184195, it is structurally possible that an electric current may flow into a transfer charger and a transfer belt when the developing cartridge (developing unit) is detached. When the developing cartridge is detached, in general, an electric current flowing into a processing device is stopped by control of software. However, when the electric current is not normally controlled, voltage may be applied between an image carrier and a processing device regardless of separation of the developing cartridge.

When the developing cartridge is separated, toner is not applied to the surface of the image carrier. In this situation, if voltage is applied between the image carrier and the processing device, the image carrier may be damaged due to the amount of charge excessively stored in the image carrier.

Aspects of the invention provide an image forming apparatus preventing damage to an image carrier by stopping an electric current flowing into a processing device when a developing cartridge is separated from the image carrier, and a process cartridge and developing cartridge used in the image forming apparatus.

According to an aspect of the present invention, there is provided an image forming apparatus including: an image carrier; a developing cartridge detachably mountable with respect to the image carrier; a processing device to which voltage acting between the image carrier and the processing device is applied; and a first electrode, wherein the developing cartridge further includes: a developing roller on which toner is capable of being held; and a second electrode capable of being electrically connected with the first electrode when the developing cartridge is mounted with respect to the image carrier, the processing device further includes: a third electrode capable of being electrically connected with the second electrode when the developing cartridge is mounted with respect to the image carrier, wherein the second electrode positions the developing cartridge in an axial direction of the developing roller.

DETAILED DESCRIPTION

Figure 1:
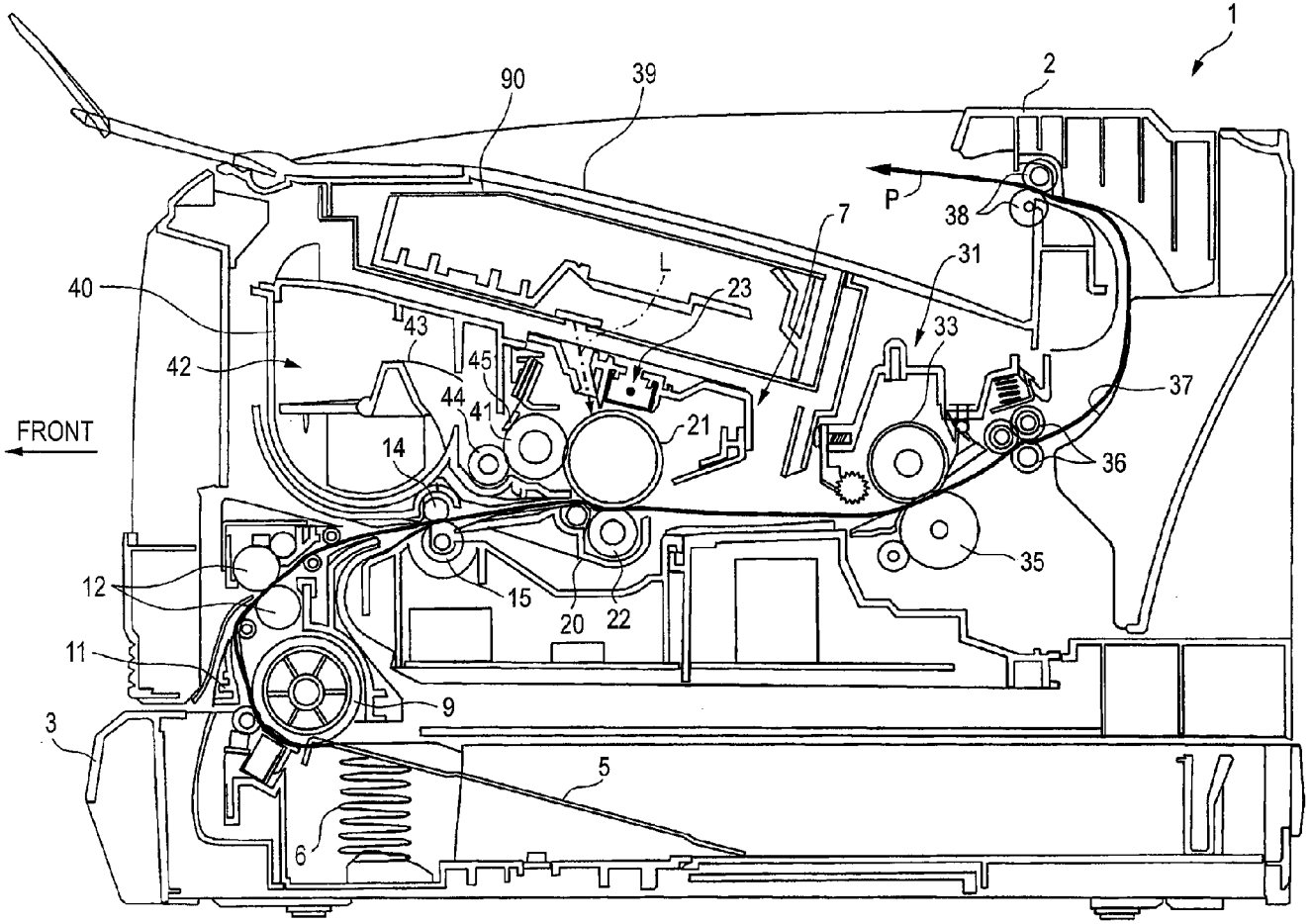
FIG. 1 is a vertical cross-sectional view showing the inside configuration of a laser printer according to an aspect of the invention.

An aspect of the invention will be described hereinafter with reference to the accompanying drawings. FIG. 1 is a vertical cross-sectional view showing the inside configuration of a laser printer 1. As shown in FIG. 1, a sheet feed cassette 3 is mounted in a lower portion of a casing 2. The casing 2 covers the main body of the laser printer 1 from the outer circumference. The sheet feed cassette 3 can be drawn out in a front direction of the laser printer 1 (i.e. the front when the laser printer 1 is set; the left side in FIG. 1).

A supporting plate 5 pushed up by a spring 6 is provided inside the sheet feed cassette 3. A sheet feed roller 9 is disposed above a front end of the supporting plate 5. The sheet feed roller 9 separates a pile of sheets P as recording media disposed on the supporting plate 5 and sends it one-by-one to an image forming portion 7. A guide 11 that reverses a sheet P conveyed by the sheet feed roller 9, conveying rollers 12 and 12 that subsequently convey the sheet P, and a pair of registration rollers 14 and 15 that stop a leading end of the sheet P and corrects the skew of the sheet P are sequentially disposed on a conveying path of the sheet P from the sheet feed roller 9 to the image forming portion 7.

The image forming portion 7 includes a photosensitive drum 21 that serves as an image carrier and disposed inside a photosensitive cartridge 20 that serves as an image carrier cartridge. The image forming portion 7 further includes a transfer roller 22 that serves as a processing device and transfer unit. The transfer roller 22 is disposed to oppose the photosensitive drum 21. The photosensitive drum 21 is a well-known drum formed by applying an organic photo conductor (OPC) on the surface of a grounded metal body.

A sheet P with an image formed by toner (described below) by passing between the photosensitive drum 21 and transfer roller 22 is sent to a fixing portion 31. The toner image formed on the sheet P is nipped between a heating roller 33 and a pressing roller 35 and fixed by heat at the fixing portion 31. The sheet P with the fixed image is then conveyed by a pair of conveying rollers 36 and 36.

The sheet P conveyed by the conveying rollers 36 is guided to an upper portion of the casing 2 by a guide 37 and then discharged though a pair of sheet discharge rollers 38 and 38 onto a sheet discharge tray 39 provided on the top of the casing 2. A scanner unit 90, which exposes the photosensitive drum 21 to laser light L, is disposed between the sheet discharge tray 39 and the photosensitive cartridge 20. The scanner unit 90 forms an electrostatic latent image by exposing the surface of the photosensitive drum 21 to the laser light L. The scanner unit 90 includes a laser light source, a polygon mirror, an fθ lens, and a reflecting mirror, etc (all not shown).

The configuration of the image forming portion 7 will be described hereafter in detail. The photosensitive cartridge 20 has the rotatable photosensitive drum 21, the transfer roller 22 and a scorotron charger 23 that uniformly charges the surfaces of the photosensitive drum 21. By the laser light L irradiated by the scanner unit 90, an electrostatic latent image is formed on the surface of the photosensitive drum 21 charged by the scorotron charger 23. A developing roller 41 (a developing unit), which is provided in a developing cartridge 40 (to be described below), applies toner onto the surface of the photosensitive drum 21 and the electrostatic latent image is subsequently developed. The toner stuck to the photosensitive drum 21 is transferred onto a sheet P passing between the photosensitive drum 21 and the transfer roller 22. Thus, the image is formed on the sheet P through the above-described operations.

The developing roller 41 is rotatably supported in the developing cartridge 40 and rotates while contacting with the photosensitive drum 21. The developing cartridge 40 also includes a toner accommodating portion 42 accommodating toner, an agitator 43 agitating the toner in the toner accommodating portion 42, a feed roller 44 applying toner discharged from the toner accommodating portion 42 by the agitator 43 to the developing roller 41, a developing blade 45 frictionally charging the toner stuck on the surface of the developing roller 41 and forming a thin layer of the toner, etc.

Figure 2A:
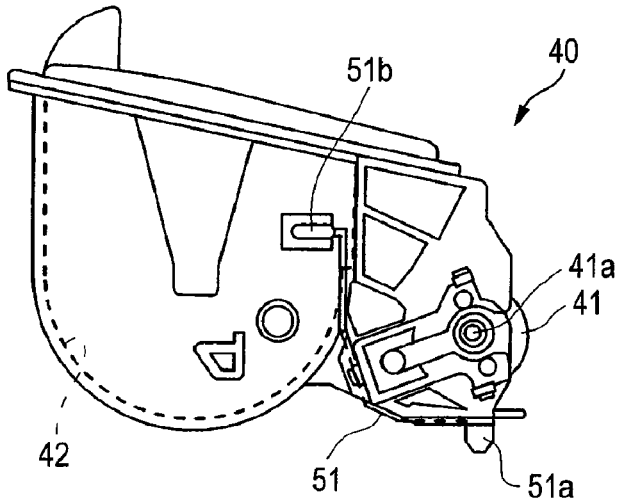
FIGS. 2A and 2B are a side view and a vertical cross-sectional view, respectively, of a developing cartridge and photosensitive cartridge of the laser printer.
Figure 2B:
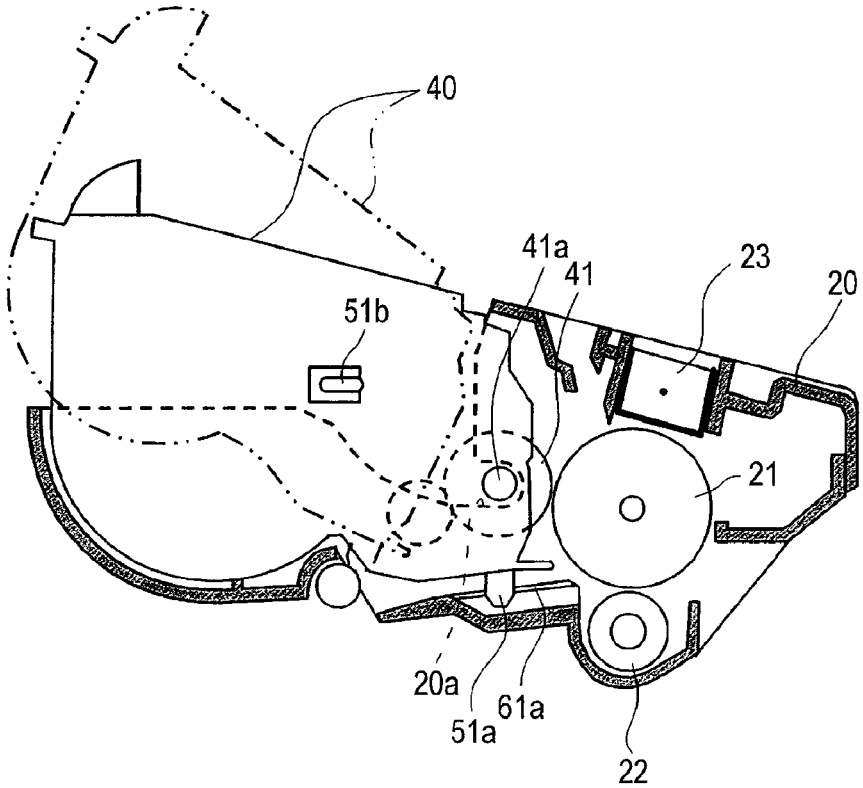

FIG. 2A is a side view of the developing cartridge 40 and FIG. 2B is a vertical cross-sectional view of the photosensitive cartridge 20. As shown in FIG. 2B, the developing cartridge 40 and photosensitive cartridge 20 that compose a process cartridge indicated by a solid line are detachable from the laser printer 1. The developing cartridge 40 is detachably mounted in the photosensitive cartridge 20 by fitting a rotational shaft 41*a* of the developing roller 41 into guide grooves 20*a* formed at both sides of the photosensitive cartridge 20.

Figure 3A:
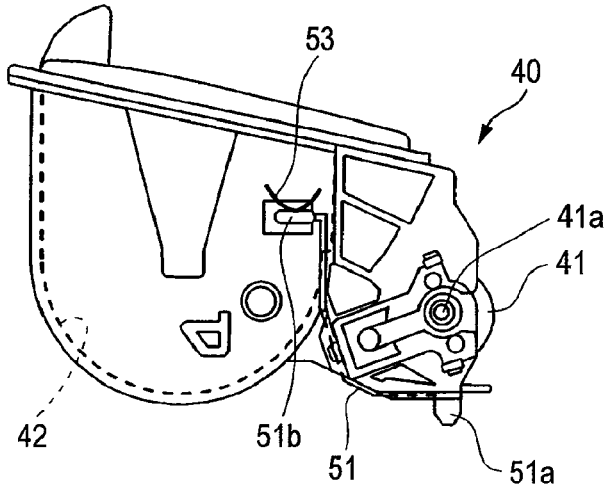
FIGS. 3A and 3B are a side view and a rear view of the developing cartridge, respectively.

The developing cartridge 40 is provided with an electrode 51 having one end 51*a* protruding downward from the developing roller 41 in a direction perpendicular to the rotational shaft 41*a* and the other end 51*b* protruding from the right side (this side in a direction perpendicular to the sheet of FIGS. 1, 2A and 2B) of the toner accommodating portion 42 in the direction of the rotational shaft 41*a*. When the process cartridge is mounted in the main body of the laser printer 1, the end 51*b* of the electrode 51 contacts with a leaf spring-shaped electrode 53 provided in the main body of the laser printer 1, as shown in FIG. 3A. As shown in a side view and rear view of FIGS. 3A and 3B, the end 51*a* of the electrode 51 is formed in a plate shape that is perpendicular to the rotational shaft 41*a* of the developing roller 41.

Figure 3B:
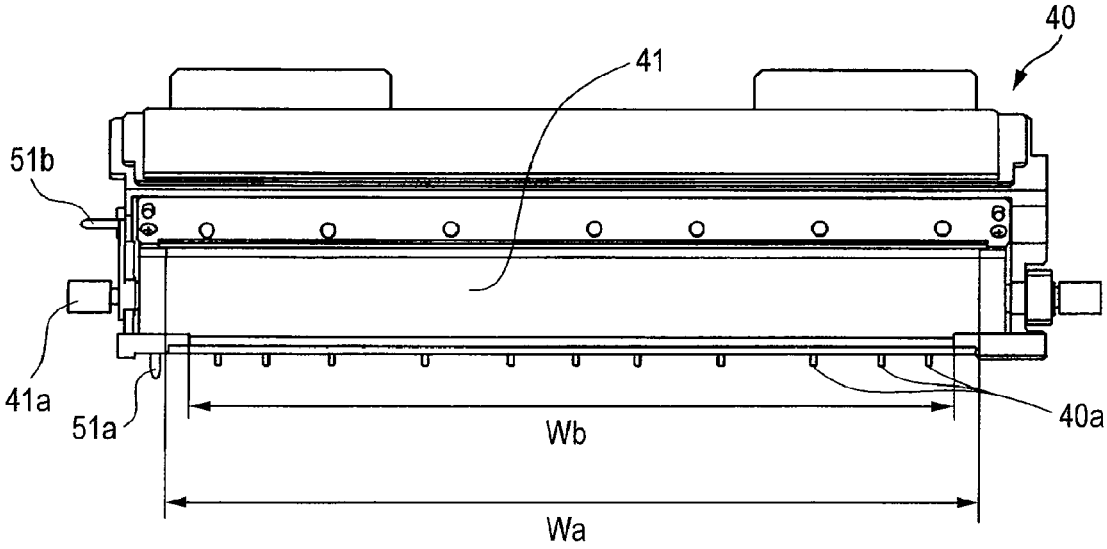

The lower surface of the developing cartridge 40 functions as a guiding surface that guides a sheet P between the photosensitive drum 21 and the transfer roller 22. A plurality of ribs 40*a* for guiding is provided along the conveying direction of the sheet P. As shown in FIG. 3B, the largest width Wa for sticking toner on the photosensitive drum 21 using the developing roller 41 and the largest sheet width Wb that is available to the laser printer 1 are shown for reference. As shown in FIG. 3B, the end 51*a* of the electrode 51 is disposed outside the largest available sheet width Wb and protrudes downward from the guiding surface.

Figure 4:
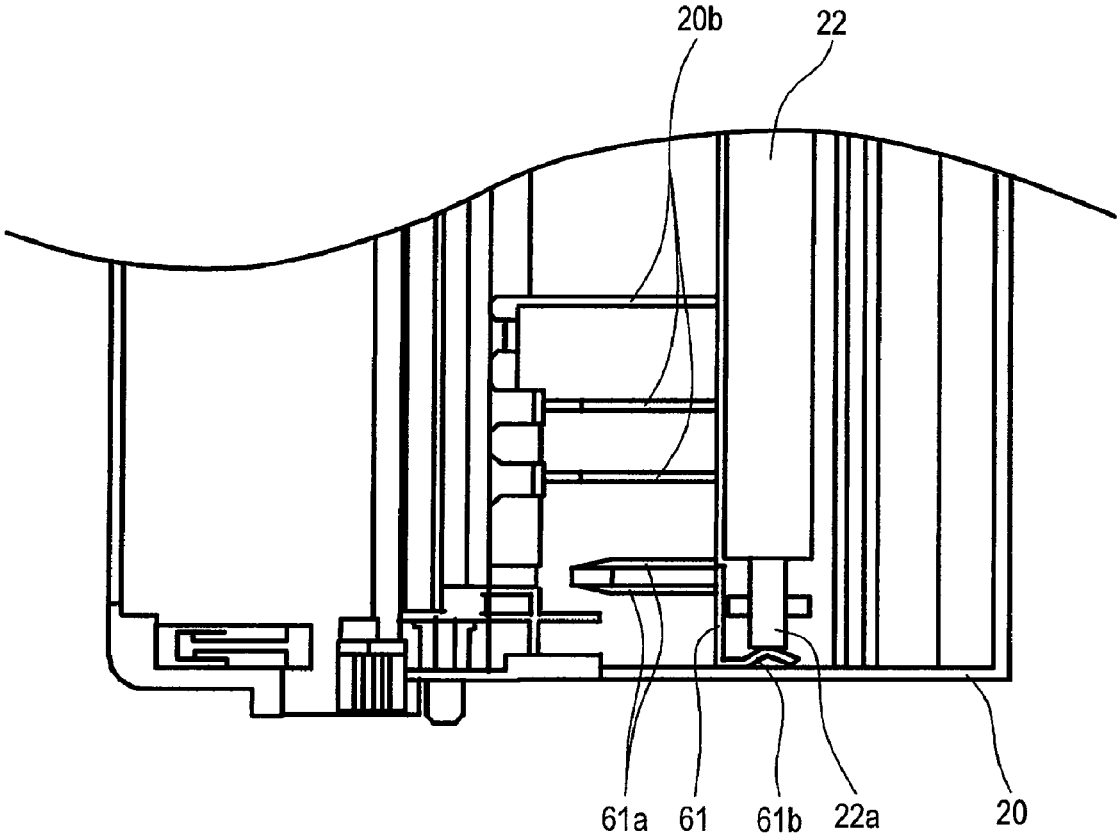
FIG. 4 is a partial top view of the photosensitive cartridge.

FIG. 4 is a partial view of a part of the photosensitive cartridge 20 lower than the photosensitive drum 21. As shown in FIG. 4, the upper surface of the photosensitive cartridge 20 is also used as a guiding surface guiding a sheet P between the photosensitive drum 21 and the transfer roller 22 and has guiding ribs 20*b* that face the above-mentioned ribs 40*a*. An end 61*a* of an electrode 61 is disposed to face the end 51*a* of the electrode 51. The end 61*a* branches into two parts to interpose the end 51*a* of the electrode 51 between them and they hold the end 51*a* tight in an axial direction of the rotational shaft 41*a* using resin elasticity. On the other hand, the other end 61*b* of the electrode 61 is in contact with a metallic rotational shaft 22*a* of the transfer roller 22. The end 61*b* is formed into a leaf spring, and in contact with the rotational shaft 22*a*, by pressing the end of the rotational shaft 22*a* in the axial direction.

Accordingly, when the developing cartridge 40 is mounted in the photosensitive cartridge 20 as shown in FIG. 2B, the end 51*a* of the electrode 51 is interposed between the two parts of the end 61*a* of the electrode 61 and they are electrically connected. Since the end 51*a* of the electrode 51 is interposed between the two parts of the end 61*a* of the electrode 61, the developing cartridge 40 is positioned in the axial direction of the developing roller 41 with respect to the photosensitive cartridge 20.

When the photosensitive cartridge 20 and the developing cartridge 40 that are combined into a unit (a process cartridge) are mounted in the main body of the laser printer 1, the end 5 lb of the electrode 51 is brought into contact with the electrode 53 and bias voltage is applied from the main body to the transfer roller 22 through the path of the electrode 53→the electrode 51→the electrode 61→the rotational shaft 22*a*. The bias voltage is constant-current-controlled by a control circuit (not shown). As described above, toner stuck on the photosensitive drum 21 is transferred onto a sheet passing between the photosensitive drum 21 and the transfer roller 22 by electrostatic attractive force. As the developing cartridge 40 is positioned, the photosensitive drum 21 and developing roller 41 are appropriately positioned with respect to each other. As a result, the electrostatic latent image formed on the photosensitive drum 21 is developed by toner excellently.

When the developing cartridge 40 is separated from the photosensitive cartridge 20, the electrodes 51 and 61 are electrically disconnected. Accordingly, when only the photosensitive cartridge 20 is mounted in the main body of the laser printer 1, bias voltage is not applied to the transfer roller 22. Therefore, bias voltage is prevented from being applied to the transfer roller 22 when the developing cartridge 40 is not mounted in the printer, thus effectively preventing damage to the photosensitive drum 21.

The both ends 51*a* and 61*a* are disposed outside the sheet conveying path formed by the guiding surfaces where ribs 40*a* and 20*b* are formed. Accordingly, when the ribs 20*b* and 40*a* are not normally positioned and a sheet P is not guided between the photosensitive drum 21 and transfer roller 22, the ends 51*a* and 61*a* are disconnected, and bias voltage is not applied to the transfer roller 22. Therefore, bias voltage is prevented from being applied to the transfer roller 22 when a sheet P cannot be guided between the photosensitive drum 21 and transfer roller 22. As a result, damage to the photosensitive drum 21 is surely prevented.

Although the aspect of the present invention has been described in connection with the detailed aspects of the present invention, it will be apparent that various modifications and changes may be made thereto without departing from the scope and spirit of the invention. For example, the image carrier may not be formed in a drum shape, but may be a belt shape of a photosensitive belt, and may be detachably provided in the main body of the laser printer 1. The transfer unit may not be limited to the roller, but may be a transfer belt or a transfer charger. The processing device may not be limited to the transfer unit, but may be other processing devices such as a conventional charging device that uniformly charges the surface of the photosensitive drum, or a conventional cleaning device that removes the toner or dusts from the surface of the photosensitive drum.

As was described, according to the above configuration, when the developing cartridge is mounted with respect to the image carrier, the electrodes provided at the processing device and the developing cartridge, respectively, are connected with each other and an electric current flows into the processing device. Accordingly, voltage is applied between the processing device and image carrier and an image is formed on a recording medium.

Further, when the developing cartridge is mounted with respect to the image carrier, the developing cartridge is positioned in the axial direction of the developing roller by connection of the pair of electrodes. Therefore, an image is excellently formed on a recording medium. Because the above-mentioned axial arrangement does not require severe precision, the electrodes are enough for the arrangement and other control members may not be required.

When the image carrier is separated from the developing cartridge, electric current cannot flow into the processing device in view of the structure because the electrodes are separated. Accordingly, when toner cannot be applied onto the image cartridge due to the separation of the developing cartridge, voltage is not applied between the image carrier and processing device. Therefore, it is possible to prevent damage to the image carrier.

Although the configuration of the electrodes is not limited, the developing cartridge may be configured so as to be detachable in a direction perpendicular to the axial direction of the developing roller and may be positioned by pinching one electrode of the developing cartridge or processing device by the other electrode in the axial direction.

A variety of processing device are considered, but the processing device may be a transfer unit to which bias voltage acting between the image carrier and the transfer unit is applied and that transfers the toner stuck on the surface of the image carrier onto the recording medium. In general, a transfer unit is constant-current-controlled for maintaining predetermined charged amount of a recording medium. In this configuration, when the developing cartridge is separated and the transfer unit is constant-current-controlled, excessive voltage may be applied to the image carrier. However, when the processing device is the transfer unit, voltage is not excessively applied to the image carrier. Accordingly, damage to the image carrier is effectively prevented.

What is claimed is:

1. A developing cartridge comprising:

a housing having a front, a rear, a top, a bottom, and sides;

a developer accommodating portion defined within the housing;

a developing roller rotatably supported by the housing, located adjacent the developer accommodating portion within the housing and partially exposed from the housing at the rear; and an electrode having a first portion protruding from the housing at the bottom near the rear and one of the sides and a second portion protruding from the housing at one of the sides, wherein the first portion and the second portion are configured to be electrically connected externally of the developing cartridge, and wherein the first portion and the second portion only convey electricity between themselves without electrically connecting to the developing roller.

2. The developing cartridge according to claim 1, wherein the first portion protrudes from a lower part of the developing roller.

3. The developing cartridge according to claim 1, wherein a rib is provided on the bottom of the housing and the first portion protrudes downward from the rib.

4. The developing cartridge according to claim 3, wherein the developing roller includes a rotational shaft projecting from one of the sides of the housing, a projecting amount of the second portion from one of the sides of the housing is smaller than a projecting amount of the rotational shaft from one of the sides of the housing.

5. The developing cartridge according to claim 1, wherein the first portion is tapered toward a distal end.

6. The developing cartridge according to claim 1, wherein the electrode extends from the second portion along one of the sides of the housing toward the bottom, is bent at the bottom toward the rear and connects to the first portion.

* * * * *